US006742982B2

(12) United States Patent
Kelly

(10) Patent No.: US 6,742,982 B2
(45) Date of Patent: Jun. 1, 2004

(54) GOLF BALL STACKING AND DISPENSING APPARATUS AND METHOD

(76) Inventor: Gregory J. Kelly, 133 Lakeshore Dr., Duluth, GA (US) 30096

( * ) Notice: Subject to any disclaimer, the term of this patent is extended or adjusted under 35 U.S.C. 154(b) by 221 days.

(21) Appl. No.: 10/023,046

(22) Filed: Dec. 17, 2001

(65) Prior Publication Data

US 2003/0113199 A1 Jun. 19, 2003

(51) Int. Cl.[7] ..... B65B 35/50

(52) U.S. Cl. ..... 414/791.5; 206/499; 211/14; 414/801; 414/802

(58) Field of Search ..... 206/315.9, 499, 206/564; 211/14, 15, 59.4, 123; 414/788, 791.5, 801, 802

(56) References Cited

U.S. PATENT DOCUMENTS 5,381,895 A * 1/1995 Thomsen ..... 206/315.9
5,467,574 A * 11/1995 Thomsen ..... 53/397
5,551,832 A * 9/1996 Kelly ..... 414/788
5,695,312 A * 12/1997 Kelly ..... 414/788
5,882,173 A * 3/1999 Ziegler ..... 414/788
D411,917 S * 7/1999 Yates ..... D3/254
5,984,112 A * 11/1999 Adams ..... 211/14
D472,752 S * 4/2003 Medendrop ..... D6/552

* cited by examiner

*Primary Examiner*—Janice L. Krizek
(74) *Attorney, Agent, or Firm*—Gibbons, Del Deo, Dolan, Griffinger & Vecchione

(57) ABSTRACT

A golf ball stacking and dispensing apparatus comprising a hopper having two pyramidal shells each of different dimensions. Each of the shells is truncated and has a respective open substantially rectangular rim defining a respective open base of a different dimension than that of the other. The shells are joined together where each is truncated so as to converge together and define a funnel opening between the shells. Each of the shells is configured to form a self-supporting stack of golf balls atop each other as a stacking tray closes the open base of one of the shells and the golf balls are poured through the other of the shells. A method of forming different size pyramidal stacks of golf balls by pouring golf balls through one pyramidal shell of a hopper to fill the other pyramidal shell thereof. The filled pyramidal shell has an open base that is closed by a tray, thereby forming a self-supporting pyramidal stack of golf balls on the tray after filling the applicable shell, and removing the hopper from the tray. Further golf balls may be poured through the other shell onto a further tray. This other shell has a differently dimensioned open base that is closed by the further trays to form a further self-supporting pyramidal stack of golf balls after pouring in the golf balls to fill two other of the shells.

27 Claims, 3 Drawing Sheets

GOLF BALL STACKING AND DISPENSING APPARATUS AND METHOD

CROSS-REFERENCE TO RELATED PATENT APPLICATIONS

Ser. No. 10/022,955, entitled "Golf Ball Stacking and Dispensing Tray," filed concurrently, now U.S. Pat. No. 6,648,138 B1.

CROSS-REFERENCE TO RELATED PATENT APPLICATIONS

"Golf Ball Stacking and Dispensing Tray," filed concurrently.

BACKGROUND OF THE INVENTION

1. Field of the Invention

The present invention relates to an apparatus and method for stacking and dispensing golf balls, and more particularly pertains to an apparatus and method for stacking golf balls in a pyramidal fashion and dispensing golf balls from the stack for use.

2. Discussion of the Related Art

It is generally desirable at golf practice areas, such as driving ranges, to provide golfers with large supplies of golf balls for use during a practice session. Conventionally, a supply of balls is provided via a basket, with the balls either removed by hand by the golfer, or the basket tipped over and the supply of balls scattered. In the former case, the golfer wastes significant time and energy in repeatedly bending over to retrieve individual balls from the basket. In the latter case, the balls are likely to scatter around the practice area, creating a cluttered practice area as well as a tripping hazard for the golfer. Additionally in the latter case, some balls are likely to roll beyond the practice area, thus requiring time-and-energy consuming retrieval by the golfer or golf facility personnel.

The prior art discloses means for providing a supply of golf balls for a practice session, where the balls are stacked in a pyramidal fashion. Square pyramidal stacks of golf balls are provided by the methods and apparatus disclosed in U.S. Pat. No. 5,381,895 to Thomsen; U.S. Pat. No. 5,467,574 to Thomsen; U.S. Pat. No. 5,551,832 to Kelly; and U.S. Pat. No. 5,882,173 to Ziegler. Such pyramidal stacking systems, all involving a tray onto which the balls are stacked, offer advantages over baskets in terms of ease of dispensing balls for use. One or more of the stacked balls may be knocked from the stack by the golfer using the head of his or her club, without the need for the golfer to repeatedly bend over to retrieve individual balls. Pyramidal stacking further avoids the balls cluttering the practice area or creating a tripping or other hazard, as is the case with a tipped basket. Pyramidal stacking offers the still further advantage of an aesthetically pleasing manner of presenting a supply of golf balls for use.

The prior pyramidal stacking apparatus and methods, however, present other limitations. The Thomsen patents disclose an apparatus for stacking golf balls comprising a tray which includes a square array of spherical depressions for receiving the golf balls, and a pyramidal hopper. The pyramidal hopper is placed over the tray and golf balls are poured into a top opening of the hopper. As balls fill the spherical depressions, the base layer of the pyramidal display is formed. As more balls are poured into the hopper, subsequent layers are formed until the pyramidal stack is complete. Larger stacks of balls may be produced in this manner. Indeed, the Thomsen patents disclose pyramidal stacks of up to 204 balls (8 layers, 8×8 balls on the bottom layer). However, Thomson's disclosure of individual spherical depressions for the bottom layer of balls in the array makes filling that layer without significant user manipulation problematic. The spherical depressions also make dispensing of the balls from the bottom layer with simply the head of a golf club, difficult.

The Ziegler patent discloses a golf ball tray having a plurality of substantially parallel rails within a rectangular frame. The rails are substantially uniformly spaced apart, with the spacing such that a golf ball may not pass between adjacent rails, but instead is constrained to lie on each of two adjacent rails and roll along their lengths in a groove formed therebetween. The spacing between the center lines of adjacent rails is larger than the diameter of a golf ball and less than 1.414 times that diameter. Balls are stacked on the tray by placing a pyramidal hopper on the tray, pouring balls into the hopper until a base layer is filled and a pyramidal stack is formed, and subsequently removing the hopper. Balls may be dispensed from the stack by rolling from the stack or along the grooves and over the side of the tray frame. In an alternative embodiment, Ziegler discloses that the top edge of the tray may be beveled to slope down inwardly toward the rails. According to Ziegler, beveling the top edge of the ball tray may facilitate dispensing golf balls over the edge of the tray. According to Ziegler, this beveling/shaping may enhance the constraint of golf balls to roll along the grooves between adjacent rails.

Ziegler discloses pyramidal stacks of 285 and 385 golf balls, which Ziegler claims will be sufficient for a two hour practice session at a "typical" rate of three balls used per minute. However, Ziegler's ball tray, even with beveled edges on the rails, includes exposed angled edges subject to deterioration from repeated forceful contact with golf balls being poured through the hopper. That is, after a period of repeated use, the forced contact of the golf balls with the edges of the rails will cause those edges to become deformed and misshapen, affecting the ability of the rails to form the requisite bottom layer of balls to support the pyramidal stack. Alternatively, where the rails are made of relatively impervious material (i.e., metal or concrete, both disclosed in Ziegler), the forced contact of the golf balls with the rigid, impervious angled edges will eventually result in damaged balls, useless to the golfer. Still further, the ball tray of Ziegler, with rails of concrete and holding a pyramidal stack of 285 or 385 balls, clearly is not portable by the average golfer or golf facility employee. That is, a golfer wishing merely to purchase and hit "a bucket of balls," (that is, approximately 100 balls), will be physically unable to do so using the ball tray disclosed in Ziegler. Further such large stacks of balls, 9 or 10 balls high, not including the height of the tray, are awkward for the average golfer to use. Still further, the ball tray of Ziegler, when fixed into the ground at the driving range site, is exposed to the weather, thus increasing the speed of deterioration of the tray.

In addition to the foregoing tray limitations, Ziegler's disclosed hopper also presents limitations. The disclosed base of the lower portion of the hopper is 18 inches square. While such dimensions may be suitable for large pyramidal stacks of balls, i.e., nine or more balls high with a base layer of at least 9×9 balls, they are unsuitable for smaller stacks, such as 6- or 7-ball high stacks of 91 or 140 balls, respectively. If the Ziegler hopper is used with a tray designed for a smaller stack, the base of the hopper will exceed the dimensions of the tray, and balls will land on the ground, rather than on the tray. If the hopper is used with a tray designed for a larger stack, a pyramidal stack of only 6 or 7 balls high will be able to be formed only with monitoring and adjustments by the golfer or golf facility employee. Even with a larger stack of balls, the Ziegler hopper, as disclosed, is suitable only for a single stack size. If a golfer or golf facility employee wishes to make two pyramidal ball stacks of different heights, whether on a single-sized tray or on trays of different sizes he or she will need to retrieve a differently-sized hopper, thus unnecessarily expending time and effort.

What is needed is an apparatus for stacking and dispensing golf balls, which allows the balls to be stacked for ease in dispensing by a golfer, and provides for ease of dispensing of all stacked balls, and is portable by the average golfer or golf facility employee. What is further needed is an apparatus for stacking and dispensing golf balls that will not deteriorate or become damaged as the result of repeated forceful contact with golf balls. What is further needed is an apparatus for stacking and dispensing golf balls that will not damage or deteriorate the golf balls as the result of repeated forceful contact with the tray. What is further needed is an apparatus for stacking and dispensing golf balls that can provide pyramidal ball stacks of different sizes. What is further needed is a method of stacking and dispensing golf balls which allows the balls to be stacked for ease in dispensing by a golfer, and that can provide pyramidal ball stacks of different sizes.

Accordingly, the present invention provides an apparatus for stacking and dispensing golf balls, which allows the balls to be stacked for ease in dispensing by a golfer, provides for ease of dispensing of all stacked balls, and is portable by the average golfer. The present invention also provides an apparatus and method for stacking and dispensing golf balls that will not deteriorate or become damaged as the result of repeated forceful contact with golf balls. The present invention further provides an apparatus and method for stacking and dispensing golf balls that will not damage or deteriorate the golf balls as the result of repeated forceful contact with the tray. The present invention still further provides an apparatus for stacking and dispensing golf balls that can provide pyramidal ball stacks of different sizes. The present invention still further provides a method of stacking and dispensing golf balls which allows the balls to be stacked for ease in dispensing by a golfer, and that can provide pyramidal ball stacks of different sizes.

BRIEF SUMMARY OF THE INVENTION

The golf ball stacking and dispensing apparatus of the present invention comprises a hopper having two pyramidal shells, wherein each of the two pyramidal shells is truncated and has a respective open substantially rectangular rim defining a respective open base of a different dimension than that of the other. The two pyramidal shells are joined together where each is truncated so as to converge together and define a funnel opening between the shells.

One of the shells is configured to form a self-supporting stack of uniformly-sized golf balls arranged in a plural number of layers atop each other as a stacking tray closes the open base of this first shell and the golf balls are poured through the other, second, shell, to fill the first shell. The second shell is configured to form a further self-supporting stack of golf balls arranged in a different plural number of layers stop each other as a further stacking tray closes the open base of this shell and the golf balls are poured through the first shell to fill the second shell.

The present invention also provides a method of forming different size pyramidal stacks of golf balls. According to this method, golf balls are poured through a second pyramidal shell of a hopper to fill a first pyramidal shell having an open base that is closed by a stacking tray, thereby forming a self-supporting pyramidal stack of uniformly-sized golf balls of a plural number of layers. The second and first pyramidal shells are truncated and joined together at the truncations to form a funnel opening between the shells. After the pyramidal stack of balls is formed, the hopper is removed from the stacking tray, leaving the self-supporting pyramidal stack of balls alone on the stacking tray. Further golf balls are poured through the first pyramidal shell, which has a differently dimensioned open base that is closed by a further stacking tray, to form a further self-supporting pyramidal stack of golf balls of a further plural number of layers that is different that the first-mentioned plural number of layers, the stacking tray and the further stacking tray being of different dimensions. After the further stack is formed, the hopper is removed from the further stacking tray, leaving the further self-supporting pyramidal stack of golf balls alone on the further stacking tray.

DETAILED DESCRIPTION OF THE INVENTION

Figure 1:
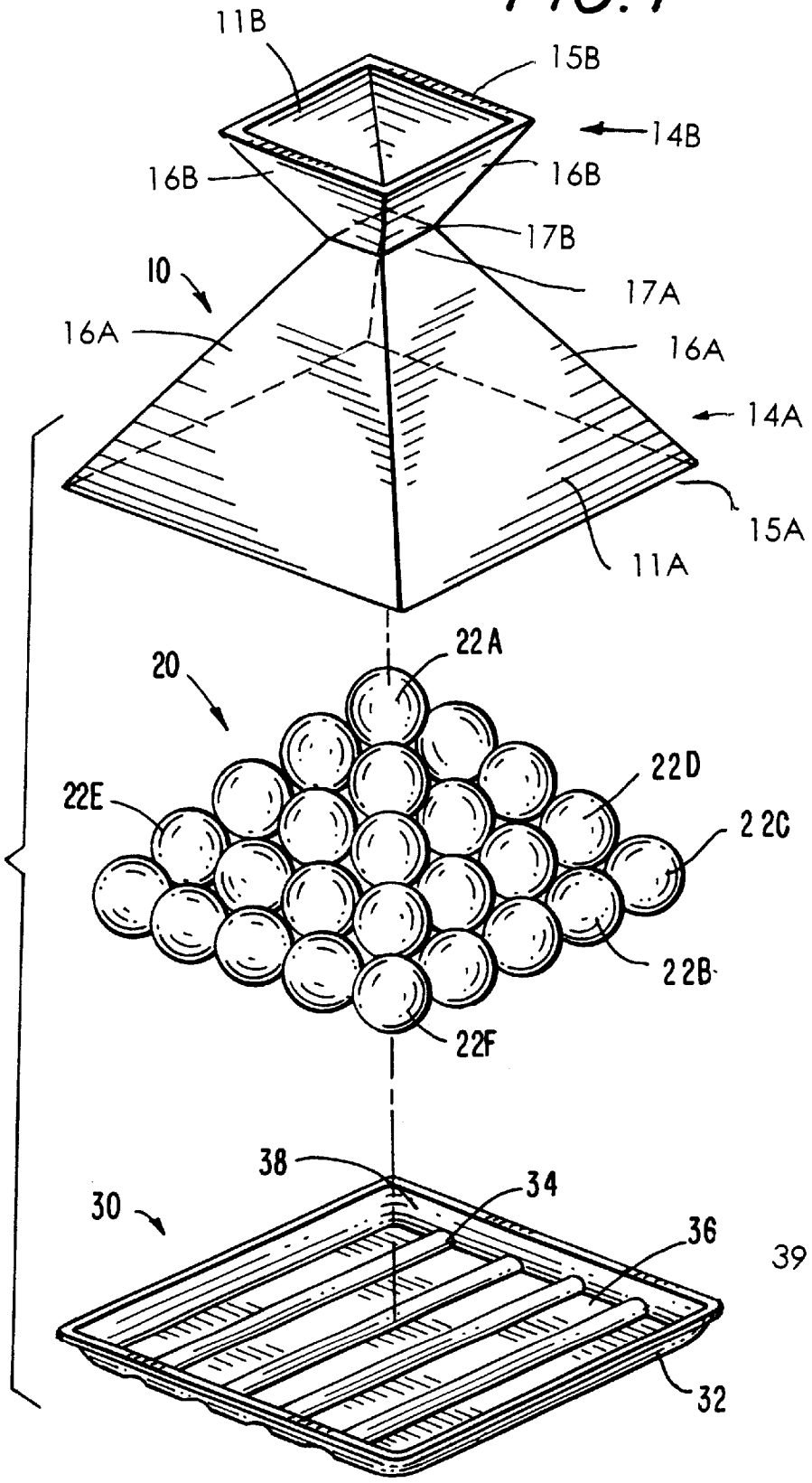
FIG. 1 shows an exploded top perspective view of the golf ball stacking and dispensing apparatus of the present invention, with a pyramidal stack of golf balls as formed by the apparatus.

Turning to FIG. 1, the golf ball stacking and dispensing apparatus of the present invention comprises a hopper 10 having a first pyramidal shell 11A and a second pyramidal shell 11B. The first pyramidal shell 11A has a first open substantially rectangular base 14A with a rim 15A, four trapezoidal faces 16A, and a first substantially rectangular-truncated opening 17A. The second pyramidal shell 11B has a second open substantially rectangular base 14B with a second rim 15B, four trapezoidal faces 16B, and a second substantially rectangular truncated opening 17B. As further shown in FIG. 1, the stacking apparatus also comprises a stacking tray 30. A self-supporting pyramidal stack 20 of uniformly sized golf balls may be formed that has a top layer 22A and additional layers beneath, including a base layer with golf balls 22B, 22C, 22F and intermediate layers that include golf balls 22D, 22E.

The first open substantially rectangular base 14A has a circumference different from that of the second open substantially rectangular base 14B. The first and second pyramidal shells 11A, 11B of the hopper 10 are arranged relative to each other such that the first truncated opening 17A is coincident with the second truncated opening 17B, thereby forming a funnel opening between the first pyramidal shell 11A and the second pyramidal shell 11B. In this manner, the first pyramidal shell 11A and the second pyramidal shell 11B may be said to converge toward each other to define the funnel opening therebetween.

Figure 2:
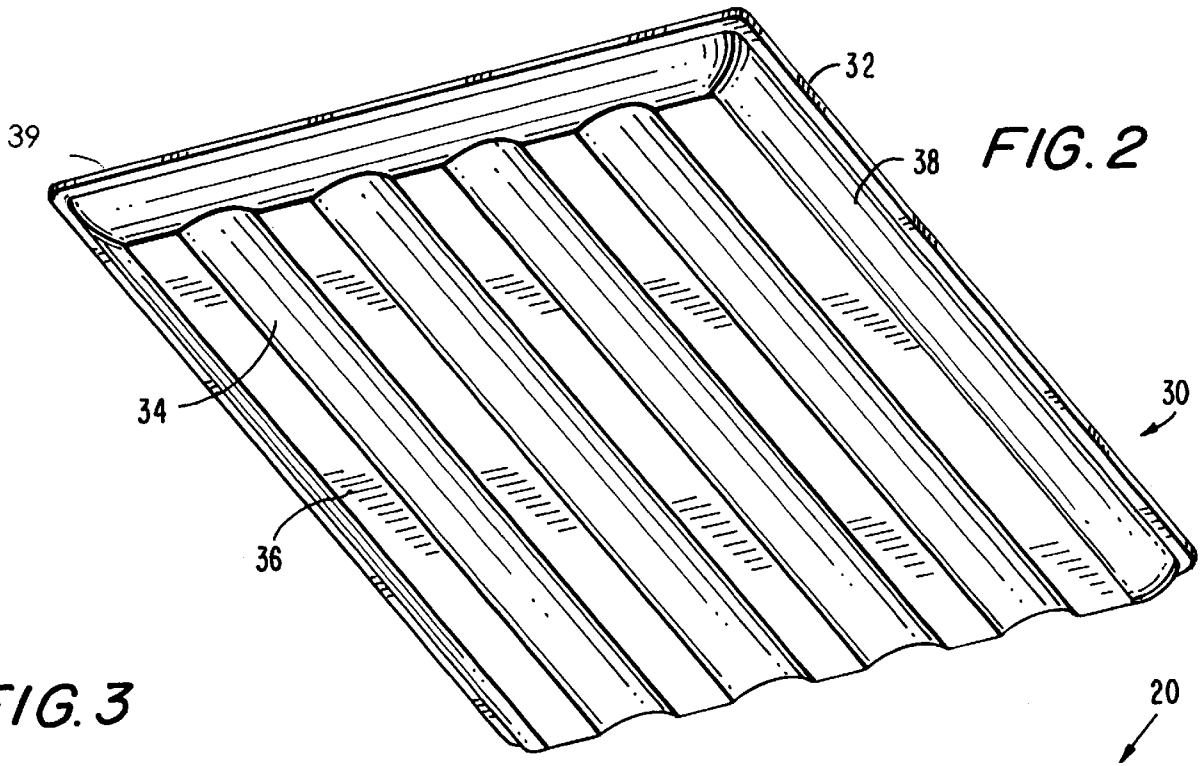
FIG. 2 shows a bottom perspective view of the tray of the golf ball stacking and dispensing apparatus of the present invention.

The stacking tray 30 comprises a substantially rectangular central region and a peripheral region that bounds the central region. The central region includes all rails 34 and resting surfaces 36. The peripheral region includes opposing and elongated sides 32, 38. The tray 30 has a top face, as seen in FIG. 1, and a bottom face, as seen in FIG. 2. The two pairs of opposing and elongated sides 32, 38 that form the boundary of the central region are concavely-curved and perpendicular with each other. Together, the two pairs of opposing sides describe a substantially rectangular frame shape with an inner perimeter coinciding with that of the outer perimeter of the central region.

Each of the rails 34 has two ends. The upper surface of each of the rails 34 (see FIG. 1) has a respective apex, all of which lie within a common tangential plane. Each of the resting surfaces 36 may be flat and has two ends, and a width bounded between neighboring ones of the rails 34. Each of the resting surfaces 36 is configured and arranged to lie outside the common tangential plane. In a preferred embodiment, the tray 30 is at least one-half inch deep and no more than one inch deep.

The ends of each of the rails 34 are integral with or attached to a transversely extending pair of opposing sides 38. Each of the plurality of rails 34 is substantially parallel to the other pair of opposing sides 32. Neighboring ones of the rails 34 are uniformly spaced apart from each other in succession and separated from each other by an adjacent one of the resting surfaces 36.

Each of the resting surfaces 36 is substantially parallel to each of the sides of the other pair of opposing sides 32, and also is substantially parallel to each of the rails 34. The ends of each of the resting surfaces 36 are attached to the same opposing one pair of transversely extending opposing sides 38 that the ends of each of the rails 34 are attached. The resting surfaces 36 are uniformly spaced apart from each other in succession and spaced apart from each other by an adjacent one of the rails 34.

Thus, the rails 34 and the resting surfaces 36 are arranged relative to each other such that neighboring of the rails 34 are separated by adjacent ones of the resting surfaces 36, and neighboring of the resting surfaces 36 are separated by adjacent ones of the rails 34.

Figure 3:
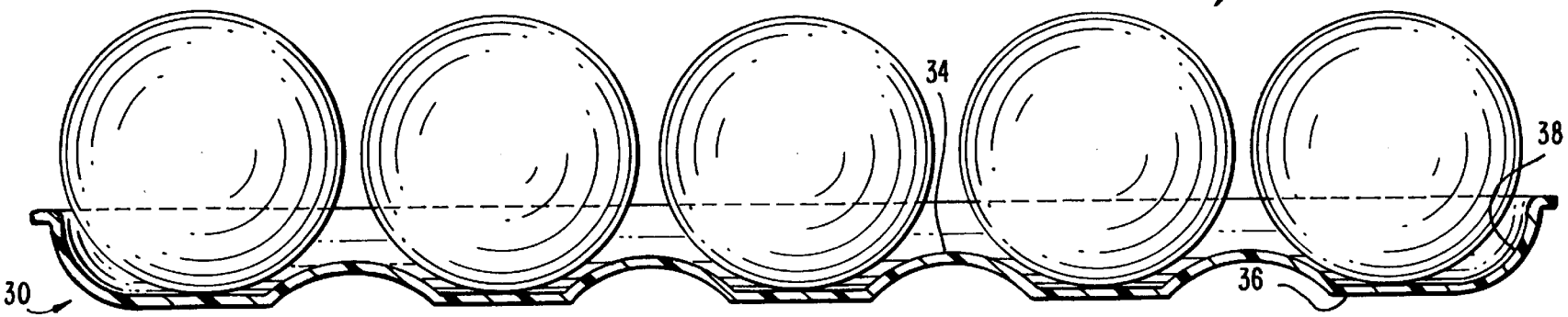
FIG. 3 shows a cutaway side view of the tray of the golf ball stacking and dispensing apparatus of the present invention, with golf balls stacked therein.
Figure 4:
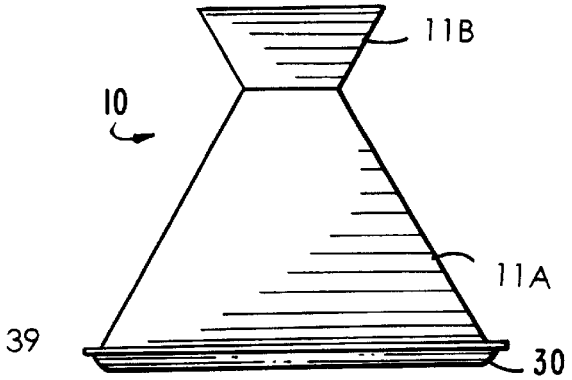
FIGS. 4–7 are progressive elevational views showing the relative position of each of four trays with respect to the hopper.
Figure 5:
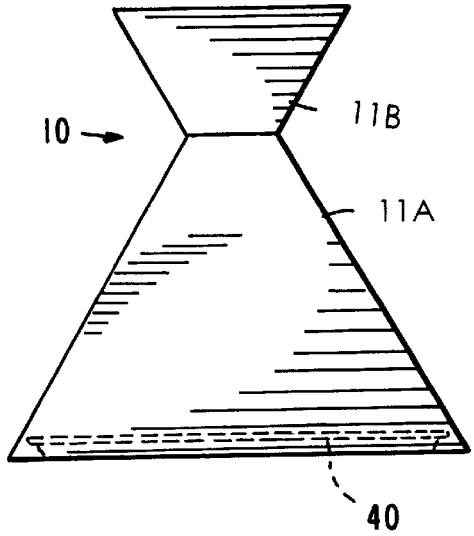
Figure 6:
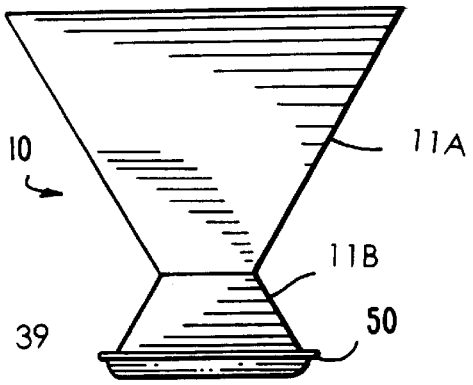
Figure 7:
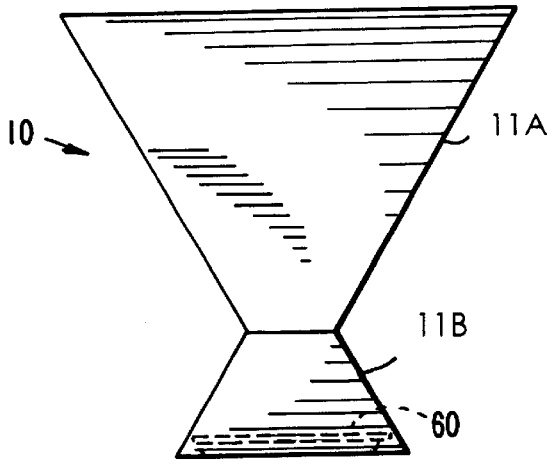

As further shown in FIG. 3, the width of each resting surface 36 is sufficient to permit a golf ball to rest on the surface 36 situated between neighboring rails 34 without contacting either of those rails 34. In addition, the upper surfaces of each of the rails 34 is convexly curved, thereby preventing the dropped balls from resting thereon and thus assuring that the dropped balls will rest on the resting surfaces 36 between neighboring rails 34.

Each of the opposing sides 32 that is parallel to each of the plurality of rails 34 and is also parallel to each of the resting surfaces 36, is also adjacent to neighboring ones of the resting surfaces 36. In this manner, the stacking tray 30 of the present invention is able to accommodate a maximum number of rows of balls (and thus a maximum number of pyramidally stacked balls) in a limited space, and with a limited weight. The other pair of transversely extending opposing sides 38 facilitates dispensing the balls from the lowest layer of the pyramidal stack.

The diameter of the rails 34 combined with the width of the resting surfaces 36 allows balls in the base layer, resting on the resting surfaces 36, to be moved easily along an axis parallel to the axis of the rails 34. That is, movement of the balls in the base layer is constrained only by the force of the balls in the succeeding layers. This facilitates the complete filling of the base layer of the pyramidal golf ball stack with little or no manipulation by the golfer or golf facility employee.

While the tray 30, when viewed from the top face, appears to have opposing sides 32, 38 in the peripheral region that are concavely curved and rails 34 in the central region that are convexly curved, the view from the bottom face is of the opposing sides 32, 38 being convexly curved and the rails 34 being concavely curved. Additionally, when the tray 30 is viewed from the top face, the resting surfaces 36 appear recessed with respect to the rails 34.

If desired, a lip 39 may be provided that extends outwardly from each opposed side 32, 38.

The hopper 10 and the stacking tray 30 are configured such that the stacking tray 30 closes the first or second open substantially rectangular base 14A, 14B of the first or second pyramidal shell 11A, 11B, respectively. For purposes of this application, the phrases "closes the open substantially rectangular base" and "closing the base" refer to the following two arrangements of a stacking tray 30 with respect to one of the first or second rims of the first or second open substantially rectangular bases 14A, 14B or the first or second pyramidal shells 11A, 11B, respectively. In a first arrangement, the rim of one of the first open substantially rectangular base 14A and the second open substantially rectangular base 14B sits on the stacking tray 30 and encloses the substantially rectangular central region. In a second arrangement, one of the first and second open substantially rectangular bases 14A, 14B bounds the stacking tray 30. In this arrangement, the rim of the base 14A, 14B bounding the tray 30 is substantially coplanar with the bottom surface of the tray 30. In both arrangements, golf balls poured through the funnel opening first form a rectangular base layer of golf balls in the tray 30, and subsequently form a pyramidal stack of golf balls consisting of a plural number of layers of balls. The hopper 10 may then be removed from the tray 30, leaving the pyramidal stack of golf balls intact.

Each of the four faces 16A, 16B of the first pyramidal shell 11A and the second pyramidal shell 11B, respectively, forms a tilt angle sufficient to allow for the formation of a pyramidal stack of golf balls therein when used in conjunction with the appropriate stacking tray 30. The height of the pyramidal stack of golf balls able to be formed using the first pyramidal shell 11A differs from that of the pyramidal stack of golf balls able to formed using the second pyramidal shell 11B.

In a preferred embodiment, the substantially rectangular central region of the tray 30 is substantially square. Preferably, each pair 32, 38 of opposing sides of the peripheral region is no more than 14 inches apart.

For the sake of brevity, FIG. 1 shows the tray 30 with four rails 34 so that a pyramidal stack 20 whose base layer is 5×5 golf balls is formed. While the first pyramidal shell 11A is shown larger than the second pyramidal shell 11B, the formations of the pyramidal stack 20 of the size shown should be made by the smaller of the two pyramidal shells 11A, 11B. This frees the larger pyramidal shell 11B to be sized to provide pyramidal stacks of an even greater number of golf balls than that of stack 20.

The golf ball stacking and dispensing apparatus of the present invention may be able to provide a regular pyramidal stack of balls of as many as 204 in number. At a rate of three balls per minute, a full stack of balls using the stacking tray of the present invention thus will support a practice session of approximately 70 minutes. Additionally, the preferred maximum pyramidal stack of balls provided by the apparatus of the present invention—eight balls in height—is sufficiently short so that an average golfer can dispense balls therefrom without discomfort or other unease.

The tray 30 of the present invention may be made of any durable, lightweight substance, such as plastic or polymers, and may be formed by a conventional plastic molding technique. The hopper 10 may be made of the same or similar durable, lightweight substance, and may be formed by similar techniques.

The use of concave curvature on opposing sides 32, 38 of the peripheral region combined with the convex curvature displayed by the upper surface of the rails 34, further promotes the durability of the stacking tray 30, as well as of the golf balls stacked thereon. Repeated dropping of golf balls onto the stacking tray 30 of the present invention (to form the base layer of balls for the pyramidal stack) will not result in damage either to the tray 30 itself, or to the balls.

By contrast, repeated dropping of golf balls onto a stacking tray having sharply angled interior edges, whether rectilinear or beveled or otherwise shaped, eventually will result in damage either to the edges, or to the balls. Repeated dropping of golf balls through the hopper and onto the rails of a tray with beveled edges or corners eventually would be expected to result in damage to the edges or corners of those rails, if the rails are not strong enough to withstand repeated impact of the balls on them. As a consequence, the rails will become pitted and otherwise misshapen, and the base layer of golf balls will not be sufficiently organized to support a pyramidal stack. Indeed, once the edges are sufficiently pitted, damaged or otherwise misshapen, a pyramidal stack will no longer be able to be supported by the stacking tray, once the hopper is removed.

In addition to damage to and eventual ruin of the sharply angled stacking tray for its intended purpose, repeated dropping of golf balls onto the sharply angled edges of the rails eventually will result in damage to the balls, themselves. That is especially true where the edged rails are made from sufficiently durable, impervious material, such as concrete, to withstand repeated impact by dropped balls. In such case, the balls themselves, whose covers have been shown by common experience to be subject to damage by contact with the edge of a golf club, will be damaged and eventually rendered useless by repeated dropping onto the rigid, sharply angled edges of the rails.

As the stacking tray must be able to be used repeatedly to be cost-effective, damage to the tray itself and/or to the balls stacked thereon severely compromises the useful life of any stacking tray having sharply angled edges. However, as noted, the use of rails 34 and opposing sides 32, 38 of the peripheral region prevents the dropped golf balls from contacting any sharply angled edge as they contact the tray 30 due to their convex/concave curvature, whether at the upper surface of one of the rails 34 or at one of the resting surfaces 36. Thus, damage to both the balls and the tray 30 is avoided, and the tray 30 may be used effectively, repeatedly, for an extended period of time, thereby reducing replacement costs to the golfer or golf course.

Additionally, the use of the hopper 10 of the present invention, where the first pyramidal shell 11A and the second pyramidal shell 11B are differently dimensioned, allows a golfer or golf facility employee to form a regular pyramidal stack of more than one size using a single hopper. Referring to FIGS. 4–7, four differently dimensioned trays 30, 40, 50 and 60 may be used. To form a square pyramidal stack, tray 30 may have seven rails 34, tray 40 may have six rails 34, tray 50 may have five rails 34 and tray 60 may have four rails 34.

By using stacking tray 30, a self-supporting pyramidal stack of is formed by setting the first pyramidal shell onto the tray 30 and pouring through the second pyramidal shell until the first pyramidal shell is filled. Once filled, the stack is self-supporting and has a base layer of 8×8 or 64 golf balls when tray 30 has seven rails 34.

By using the further tray 40, a further self-supporting pyramidal stack of golf balls forms by setting the second pyramidal shell onto the further tray 40 and pouring through the first pyramidal shell until filling the second pyramidal shell. The stack has an 6×6 or 36 golf ball base layer when the further tray 40 has five rails 34.

By using the additional tray 50, the same procedure is followed as for stacking tray 30, except that the additional tray 50 is inserted into the open base of the first pyramidal shell 11A to close the open base. That is, the rim of the open base of the first pyramidal shell 11A becomes coplanar with the underside of the additional tray 50 as they rest on the ground. The base layer of the additional self-supporting pyramidal stack of golf balls that forms is 7×7 or 49 golf balls when the tray 50 has six rails 34.

By using the different tray 60, its underside becomes coplanar with the rim of the open base 14B of the second pyramidal shell 11B, closing the same when they are on the ground. This arises by inserting the tray 60 into the open base 14B. The base layer of the different self-supporting pyramidal stack of golf balls that forms from filling the second pyramidal shell 11B has a base layer of 6×6 or 36 balls when the tray 60 has four rails 34.

The golfer/golf facility employee is thus able to provide two differently sized pyramidal stacks, whether for a single golfer (in this illustration, hitting 231 balls in a 77 minute session) or for two golfers (in this illustration, one hitting 140 balls in a 45-minute session, the other hitting 91 balls in a 30-minute session). The golfer/golf facility employee thus saves space, time and effort in providing differently sized pyramidal stacks of balls for golfers desiring same.

Thus, using trays 30, 40, 50 and 60 will provide four different sized pyramids each with a different number of golf balls forming the pyramidal stack.

To vary the number of balls in the base layer, the hopper may be replaced by a hopper that is longer in one direction than the other to produce a rectangular pyramid of golf balls, instead of a square pyramid. The height of the hopper is capable of forming a rectangular pyramid stack that may be the same height as that of the hopper capable of forming the square pyramid. However, the total number of golf balls that will be stacked differs depending upon the dimension of the tray on which the golf balls are to be stacked.

Since the hopper may be used with any of four different sized trays 30, 40, 50, 60, the trays may each have unique visual indicia, such as different colors on the number of golf balls in the stack they form, so as to distinguish one over the other. This will help users to quickly select the appropriate tray to use with the hopper to attain a desired stack.

To help in stability during pouring when external trays 30 or 40 are used, clips (not shown) may be used to keep the hopper and external tray together. Such clips are secured to the hopper adjacent one or both of the rims and clip onto edges of the trays 30, 40, as applicable.

As an alternative, the rims of the open bases of the hopper may be of the same dimension and each used with a tray of different dimension. Thus, with respect to a first pyramidal shell, one tray is arranged external for golf ball stacking so that the first pyramidal shell sits on the tray and thus is without confines of the first pyramidal shell when closing the open base of the first pyramidal shell. With respect to the second pyramidal shell, the other tray is arranged internal for golf ball stacking so as to be within confines of the second pyramidal shell when closing the open base of the second pyramidal shell.

If desired, the hopper may have just one pyramidal shell, with perhaps an opposite pyramidal shell for purposes of pouring in golf balls. Two different sized trays may be used on the one pyramidal shell for forming two different size pyramid stacks of golf balls. The smaller of the trays is inserted within the confines of the pyramidal shell so that its underside is coplanar with a rim of the open base of the pyramidal shell. The golf balls are poured through the truncated opening of the pyramidal shell to form the stack. After removing the hopper, the hopper may then be placed to sit atop the larger tray, which closes the open base but remains outside the confines of the hopper. Additional golf balls are poured through the truncated opening to form an additional pyramidal stack of the additional golf balls.

While the invention has been described with respect to certain specific embodiments, it will be appreciated that many modifications and changes may be made by those skilled in the art without departing from the invention. It is intended, therefore, by the appended claims to cover all such modifications and changes as may fall within the true spirit and scope of the invention.

What is claimed is:

1. A golf ball stacking and dispensing apparatus, comprising a hopper having two pyramidal shells, wherein:

each of the two pyramidal shells is truncated and has a respective rim defining a respective open base;

the two pyramidal shells are joined together where each of the two pyramidal shells is truncated so as to converge together and define a funnel opening between the two pyramidal shells;

a first of the two pyramidal shells is configured to form a self-supporting stack of uniformly-sized golf balls arranged in a plural number of layers atop each other as a stacking tray closes the open base of the first of the two pyramidal shells and golf balls fill the first of the two pyramidal shells after pouring through a second of the two pyramidal shells; and the second of the two pyramidal shells is configured to form a further self-supporting stack of the uniformly-sized golf balls arranged in a different plural number of layers atop each other as a further stacking tray closes the open base of the second of the two pyramidal shells and the golf balls fill the second of the two pyramidal shells after pouring through the first of the two pyramidal shells.

2. The stacking and dispensing apparatus of claim 1, further comprising the stacking tray and the further stacking tray, wherein the stacking tray is sized and arranged to close the open base of the first of the two pyramidal shells, and the further stacking tray is of a different dimension than that of the stacking tray and is sized and arranged to close the open base of the second of the pyramidal shells.

3. The stacking and dispensing apparatus of claim 2, wherein each of the stacking tray and the further stacking tray comprises:

a base frame having a central region bounded by a peripheral region, the peripheral region including two pairs of opposing, concavely-curved sides forming a boundary of the central region and that are perpendicular to each other, the central region having a width defined between one or the two pairs of opposing, concavely-curved sides;

a plurality of convexly curved rails; and a plurality of resting surfaces, and wherein:

the rails and resting surfaces are arranged relative to each other in a parallel, uniform manner across the width of the central region, such that neighboring ones of the rails are separated from each other by adjacent ones of the resting surfaces and neighboring ones of the resting surfaces are separated from each other by adjacent ones of the rails;

each of the resting surfaces has a width bounded between neighboring ones of the rails that is sufficient to permit a golf ball to rest on the resting surface situated between the neighboring ones of the rails without contacting said rails;

each of the rails having an associated apex, the apexes of the plurality of the rails being in a common tangential plane with each other;

the plurality of rails and the plurality of resting surfaces are arranged in parallel with the one pair of the two pairs of opposing, concavely-curved sides of the peripheral region of the base frame; and the opposing, concavely-curved sides of the one pair are adjacent to neighboring ones of the plurality of resting surfaces.

4. The stacking and dispensing apparatus of claim 3, wherein the rails of the stacking tray and the rails of the further stacking tray are integrally formed with and thus in connection with the other pair of the two pairs of opposing, concavely-curved sides of the peripheral region of respective ones of the stacking tray and the further stacking tray.

5. The stacking and dispensing apparatus of claim 3, wherein the resting surfaces of the stacking tray and the resting surfaces of the further stacking tray are integrally formed with and thus in connection with the other pair of the two pairs of opposing, concavely-curved sides of the peripheral region of respective ones of the stacking tray and the further stacking tray.

6. The stacking and dispensing apparatus of claim 3, wherein each of the plurality of resting surfaces in the stacking tray and the further stacking tray is flat.

7. The stacking and dispensing apparatus of claim 3, wherein the stacking tray and the further tray each have a surface with a unique visual indication that helps distinguish one from the other visually.

8. The stacking and dispensing apparatus of claim 3, wherein the central region of the stacking tray and the central region of the further stacking tray are substantially rectangular.

9. The stacking and dispensing apparatus of claim 3, wherein the stacking tray and the further tray each have a different number of spaced apart rails than that of the other.

10. The stacking and dispensing apparatus of claim 9, further comprising an additional tray having a fewer number of rails than the stacking tray, the additional tray being positioned to close the open base of first of the two pyramidal shells at a position further inside of the first of the two pyramidal shells than where the stacking tray closes the open base of the first of the two pyramidal shells.

11. The stacking and dispensing apparatus of claim 9, further comprising a different tray having a fewer number of rails than that of the further tray, the different tray being positioned to close the open base of the second of the two pyramidal shells at a position further inside of the second of the two pyramidal shells than where the further tray closes the open base of the second of the two pyramidal shells.

12. The stacking and dispensing apparatus of claim 1, wherein the rim of the open base of the first shell is of a different dimension than that of the rim of the open base of the second shell.

13. A method of forming different size pyramidal stacks of golf balls with a hopper having first and second pyramidal shells, comprising:

closing an open base of the second pyramidal shell of the hopper with a stacking tray;

pouring golf balls through the first-pyramidal shell of the hopper to fill the second pyramidal shell of the hopper so as to form on the stacking tray a self-supporting pyramidal stack of a plural number of layers of uniformly-sized golf balls, the second pyramidal shell and the first pyramidal shell each being truncated and being joined together where each is truncated so as to form a funnel opening between the second pyramidal shell and the first pyramidal shell;

removing the hopper from the stacking tray to leave the self-supporting pyramidal stack of uniformly-sized golf balls alone on the stacking tray;

closing an open base of the first pyramidal shell of the hopper with a further tray;

pouring further golf balls through the second pyramidal shell of the hopper to fill the first pyramidal shell so as to form on the further tray a further self-supporting pyramidal stack of a further plural number of layers of uniformly-sized golf balls that is different than that of the first-mentioned plural number of layers, the stacking tray and the further stacking tray being of different dimensions; and removing the hopper from the further stacking tray to leave the further self-supporting pyramidal stack of uniformly-sized golf balls alone on the further stacking tray.

14. The method of claim 13, wherein the stacking tray is arranged without confines of the second pyramidal shell during pouring golf balls through the first pyramidal shell, so that the open base of the second pyramidal shell sits atop the stacking tray.

15. The method of claim 13, wherein the stacking tray is arranged within confines of the second pyramidal shell during pouring golf balls through the first pyramidal shell, so that the stacking tray is inserted within the open base of the second pyramidal shell.

16. The method of claim 13, wherein the further stacking tray is arranged without confines of the first pyramidal shell during pouring further golf balls through the second-pyramidal shell, so that the open base of the first pyramidal shell sits atop the further stacking tray.

17. The method of claim 13, wherein the further stacking tray is arranged within confines of the first pyramidal shell during pouring further golf balls through the second pyramidal shell, so that the further stacking tray is inserted within the open base of the first pyramidal shell.

18. The method of claim 14, further comprising closing the open base of the first pyramidal shell of the hopper with an additional stacking tray, pouring additional golf balls through the second pyramidal shell of the hopper to fill the first pyramidal shell of the hopper, the additional stacking tray being within confines of the first pyramidal shell to enable formation of an additional self-supporting pyramidal stack of an additional number of uniformly-sized golf balls that is different in number from the first-mentioned plural number and the further plural number, the additional stacking tray being of a different dimension than that of the stacking tray and the further stacking tray; and removing the hopper from the additional stacking tray to leave the additional self-supporting pyramidal stack of uniformly-sized golf balls alone on the additional stacking tray.

19. The method of claim 18, further comprising closing the open base of the second pyramidal shell with a different stacking tray, pouring different golf balls through the first pyramidal shell of the hopper to fill the second pyramidal shell so as to form a different self-supporting pyramidal stack of a different number of uniformly-sized golf balls that is different in number from the first-mentioned plural number and the further plural number and the additional plural number, each of the stacking tray, the further stacking tray, the additional stacking tray and the different stacking tray being of different areal dimensions relative to each other; and removing the hopper from the different stacking tray to leave the different self-supporting pyramidal stack of uniformly-sized golf balls alone on the different stacking tray.

20. A golf ball stacking and dispensing apparatus, comprising a hopper having a pyramidal shell that has an open base bounded by a rim; two trays each of a different dimension, a first of the trays being configured and arranged to close the open base by fitting the rim onto the first of the trays so that the first of the trays is outside of confines of the pyramidal shell, a second of the trays being configured and arranged to close the open base by being inserted within confines of the pyramidal shell and having an underside that is arranged coplanar with the rim while the second of the trays is within the confines of the pyramidal shell.

21. A method of stacking and dispensing golf balls using a hopper and two trays each of a different dimension, the hopper having a pyramidal shell that has an open base bounded by a rim; comprising closing the open base of the pyramidal shell with a first of the trays by fitting the rim onto the first of the trays so that the first of the trays is outside of confines of the pyramidal shell; removing the first of the trays; and closing the open base of the pyramidal shell with a second of the trays by inserting the second of the trays within confines of the pyramidal shell, arranging an underside of the second of the trays coplanar with the rim while the second of the trays is within the confines of the pyramidal shell.

22. A method as in claim 21, wherein the pyramidal shell has an opening formed at a location where the pyramidal shell is truncated, further comprising pouring golf balls through the opening while the first of the trays closes the open base of the pyramidal shell to form a pyramidal stack of the golf balls on the first of the trays and pouring additional golf balls through the opening while the second of the trays closes the open base of the pyramidal shell to form an additional pyramidal stack of the additional golf balls on the second of the trays.

23. A golf ball stacking and dispensing apparatus, comprising a hopper having two truncated pyramidal shells each with an open base bounded by a rim and connected to each other by a funnel opening formed by and between the two truncated pyramidal shells; two trays each of a different dimension, a first of the trays being configured and arranged to close the open base of one of the two truncated pyramidal shells, a second of the trays being configured and arranged to close the open base of the other of the two truncated pyramidal shells.

24. A golf ball stacking and dispensing apparatus of claim 23, wherein the first of the trays is located without confines of the open base of the one of the two truncated pyramidal shells when closing same, by fitting the rim onto the first of the trays.

25. A golf ball stacking and dispensing apparatus of claim 23, wherein the first of the trays is located within confines of the open base of the one of the two truncated pyramidal shells to close same.

26. A golf ball stacking and dispensing apparatus of claim 25, wherein the first of the trays has an underside that is arranged coplanar with the rim while the first of the trays is within the confines of the one of the two truncated pyramidal shells.

27. A golf ball stacking and dispensing apparatus of claim 20, wherein the pyramidal shell is truncated.

* * * * *